US007801324B2

(12) United States Patent
Kimura et al.

(10) Patent No.: US 7,801,324 B2
(45) Date of Patent: Sep. 21, 2010

(54) SPEAKER APPARATUS

(75) Inventors: Yoshihiro Kimura, Yamagata (JP); Masanori Ito, Yamagata (JP)

(73) Assignees: Pioneer Corporation, Tokyo (JP); Tohoku Pioneer Electronic Corporation, Yamagata (JP)

( * ) Notice: Subject to any disclaimer, the term of this patent is extended or adjusted under 35 U.S.C. 154(b) by 1206 days.

(21) Appl. No.: 11/393,835

(22) Filed: Mar. 31, 2006

(65) Prior Publication Data

US 2006/0239494 A1 Oct. 26, 2006

(30) Foreign Application Priority Data

Mar. 31, 2005 (JP) ..... P2005-102349

(51) Int. Cl.
*H04R 1/00* (2006.01)

(52) U.S. Cl. ..... 381/430; 381/423; 381/424; 381/426

(58) Field of Classification Search ..... 381/423–432
See application file for complete search history.

(56) References Cited

U.S. PATENT DOCUMENTS 4,321,434 A * 3/1982 Irie ..... 181/173
4,761,817 A * 8/1988 Christie ..... 381/398
5,590,211 A * 12/1996 Chang ..... 381/398
6,516,077 B1 * 2/2003 Yamaguchi et al. ..... 381/424
6,697,496 B2 * 2/2004 Frasl ..... 381/398
7,306,073 B2 * 12/2007 Frasl ..... 181/173
7,483,545 B2 * 1/2009 Nagaoka ..... 381/423
2007/0053547 A1 * 3/2007 Ando ..... 381/430

FOREIGN PATENT DOCUMENTS

JP 5-183986 A 7/1993
JP 2002-271887 A 9/2002
JP 2004-48494 A 2/2004

* cited by examiner

*Primary Examiner*—Curtis Kuntz
*Assistant Examiner*—Ryan Robinson
(74) *Attorney, Agent, or Firm*—Sughrue Mion, PLLC

(57) ABSTRACT

A speaker apparatus comprises a dome type diaphragm comprising: a reinforcing rib; and an edge damper integrally formed with an outer periphery of the dome type diaphragm; and a frame supporting the dome type diaphragm through the edge damper. The reinforcing rib comprises at least one of a groove portion and a ridge portion. The reinforcing rib is extended radially with respect to the dome center portion from a vicinity of a dome center portion of the dome type diaphragm to a dome outer periphery side.

3 Claims, 4 Drawing Sheets

SPEAKER APPARATUS

CROSS-REFERENCE TO RELATED APPLICATIONS

This application is based on and claims the benefit of priority from the prior Japanese Patent Application No. 2005-102349, filed on Mar. 31, 2005; the entire contents of which are incorporated herein by reference.

TECHNICAL FIELD

The present invention relates to a speaker apparatus in which a dome type diaphragm is supported by a frame an edge damper integrated with an outer periphery thereof.

BACKGROUND

A speaker apparatus in which a dome type diaphragm is supported by a frame through an edge damper integrated with an outer periphery thereof has been spread for a vehicle-mounted audio apparatus or for a portable apparatus since an angle of emitting sound is wider than that of a speaker apparatus using a cone type diaphragm, a stable sound field can be formed by a wide angle and the speaker apparatus is suitable for small-sized formation.

A development of an elliptical shape dome speaker apparatus using an outer peripheral shape of a diaphragm in an oval shape or an elliptical shape is remarkable as a dome type diaphragm since the speaker apparatus achieves an excellent low region reproducing characteristic by gaining an area of the diaphragm even in a narrow installing space particularly for a small-sized portable apparatus.

According to a speaker apparatus using the dome type diaphragm, a method of adjusting a compliance (deformability=flexibility) of an edge damper is known as a method of setting a low sound resonance frequency (fo) to a desired value.

In a related art, a compliance of the edge damper is adjusted by changing a width (edge width), a height (roll height), a material thickness of a damper main body. The damper main body is integrated to an outer periphery of a diaphragm and is deformed in accordance with an amplitude of the diaphragm.

However, the width or the height or the material thickness of the damper main body cannot be changed by large amounts. It is difficult to promote a degree of freedom or adjusting the compliance.

Hence, as shown by FIG. 1, it is proposed to form reinforcing ribs 7 at a damper main body 5 of an edge damper 3 integrated to an outer periphery of a dome type diaphragm 1 at predetermined intervals in a peripheral direction (refer to, for example, JP-A-2004-48494 and JP-A-2002-271887).

According to the dome type diaphragm 1 shown in FIG. 1, a shape of an outer periphery of the diaphragm is oval.

The edge damper 3 is constituted by the damper main body 5 deformed in correspondence with amplitude of the diaphragm formed in a sectional shape of a roll-like shape, and an attaching flange portion 9 extended to an outer periphery thereof and fixed to an edge attaching portion of a frame.

The reinforcing rib 7 is a groove portion or a ridge portion formed at the damper main body 5 by pressing. The reinforcing rib 7 is formed by a pertinent length to be along a width direction of the damper main body 5 in a range of the damper main body 5 excluding a vicinity of an inner peripheral portion thereof and a vicinity of an outer peripheral portion thereof.

According to the reinforcing rib 7, a compliance of the edge damper 3 can be adjusted even by adjusting an interval of mounting the reinforcing ribs 7, a length dimension of the reinforcing rib 7 or the like. A degree of freedom of adjusting the compliance can be promoted. Accordingly, an adjustment of a low sound resonance frequency (fo) is facilitated.

Further, as a speaker apparatus using a dome type diaphragm, in order to strengthen a rigidity of a dome portion, a reinforcing rib is provided at an outer peripheral edge of a diaphragm fixed with a voice coil, so that a disturbance in a high region frequency characteristic is reduced by a harmonic distortion (refer to, for example, JP-A-5-183986 and JP-A-11-355883).

SUMMARY

However, when the dome type diaphragm and the edge damper is integrally formed with a thin-walled film member (e.c. a speaker apparatus having a small aperture), as described above, it is difficult to ensure a sufficient rigidity in the diaphragm by only the reinforcing rib which is provided at the outer peripheral edge of the diaphragm fixed with the voice coil.

Particularly, when the dome portion is increased, the rigidity becomes deficient gradually. It is difficult to reduce a disturbance in a high region frequency characteristic by a harmonic distortion.

Further, according to the above-related art, even though the reinforcing rib 7 is formed in the range of the damper main body 5 excluding the vicinity of the inner peripheral portion and the vicinity of the outer peripheral portion, an effect cannot be expected so much for improving the rigidity of the outer peripheral edge per se of the damper main body.

Therefore, in the case of the edge damper integrated to the dome type (e.c. oval shape or elliptical shape) diaphragm, as shown by FIG. 1, in a surrounding of the diaphragm, a region S1 in correspondence with a linear portion of an oval and a region in a circular arc shape on both sides thereof, a difference of basic compliances therebetween is considerable also in view of an influence of the rigidity of the dome portion.

Therefore, according to the related art, even though the reinforcing rib 7 is formed in the range of the damper main body 5 excluding the vicinity of the inner peripheral portion and the vicinity of the outer peripheral portion as described above, a variation in compliances at respective regions cannot be nullified. There is another problem that it is difficult to adjust a low sound resonance frequency (fo) as aimed even when the compliances are adjusted.

The present invention has been made in view of the above circumstances and provides a speaker apparatus.

According to an aspect of the invention, the speaker apparatus can carry out high grade acoustic reproduction and reduce a disturbance in a high region frequency characteristic by a harmonic distortion by ensuring a sufficient rigidity in a dome type diaphragm.

According to another aspect of the invention, a speaker apparatus can ensure a desired compliance without a variation over an entire region of a surrounding of a diaphragm and can adjust a low sound resonance frequency (fo) as aimed.

BRIEF DESCRIPTION OF THE DRAWINGS

These and other objects and advantages of this invention will become more fully apparent from the following detailed description taken with the accompanying drawings in which.

DESCRIPTION OF THE EMBODIMENTS

Embodiments will be explained in details in reference to the drawings as follows.

Figure 1:
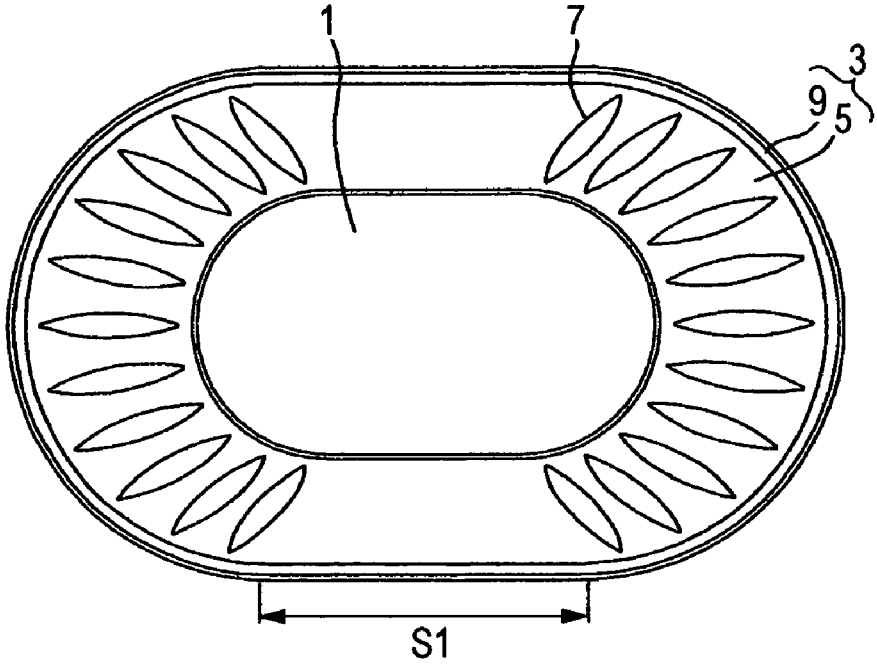
FIG. 1 is a front view of a dome type diaphragm and an edge damper of a speaker apparatus according to a related art.
Figure 2:
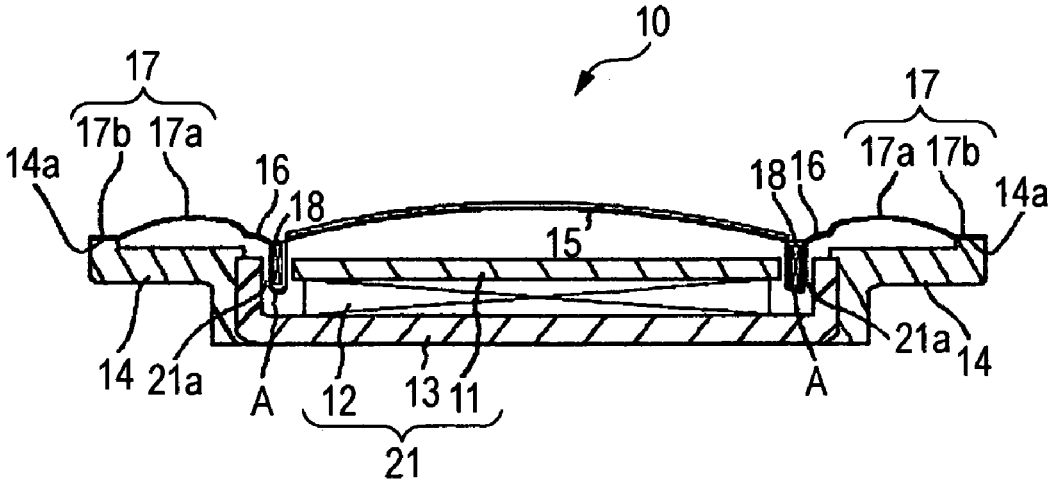
FIG. 2 is a vertical sectional view of a speaker apparatus according to a first embodiment.
Figure 3:
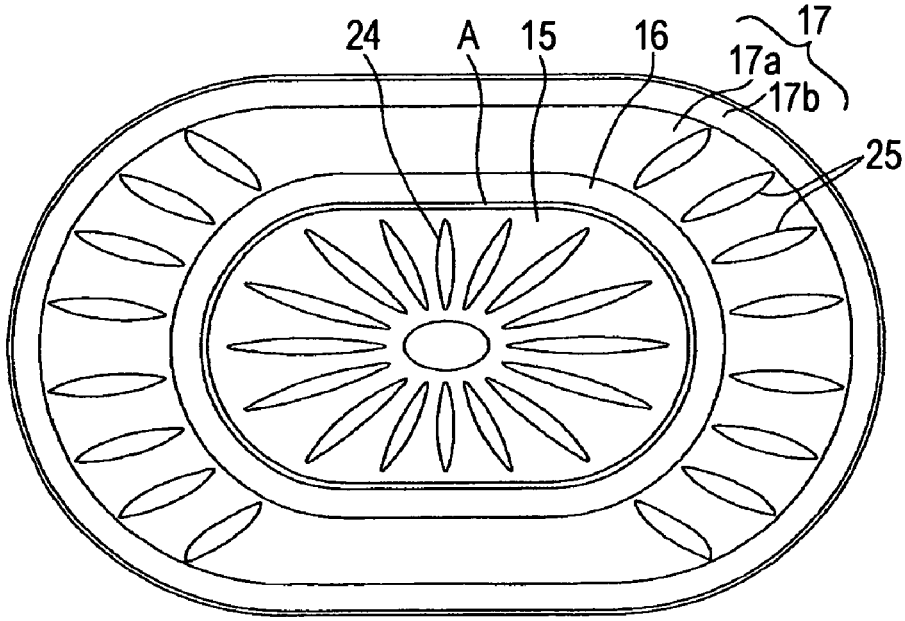
FIG. 3 is a front view of a dome type diaphragm and an edge damper shown in FIG. 2.

FIG. 2 is a vertical sectional view of a speaker apparatus according to a first embodiment, FIG. 3 is a front view of a dome type diaphragm and an edge damper shown in FIG. 2.

As shown by FIG. 2, a speaker apparatus 10 is provided with a pole plate 11 having an aperture in an oval shape, a magnet 12 and a yoke 13 for forming a magnet circuit 21 having a magnetic gap 21*a* in an oval ring shape, a frame 14 for supporting a lower portion of the speaker apparatus 10, a dome type diaphragm 15, edge dampers 16, 17 integrated with an outer periphery of the diaphragm 15 through a coil containing groove A (hereinafter, referred to as "groove A"), and a coreless voice coil 18 (hereinafter, referred to as "voice coil") in an oval shape fitted into the groove A and fixed thereto by an adhering agent or the like. The dome type diaphragm 15 has a shape of flattening an egg shape constituting a cut face by an ellipse.

The groove A is a recess portion having a section in a U-like shape. The recess portion is formed to be interposed at a boundary portion of a dome outer periphery of the diaphragm 15 and an inner periphery of the groove A. The groove A is formed in an oval ring shape along a dome outer periphery.

As shown in FIG. 3, the edge dampers 16, 17 are provided with a first stage edge damper 16, a damper main body 17*a*, and an attaching flange portion 17*b*. A first stage edge damper 16 has a section in a roll-like shape integrated to the outer periphery of the diaphragm 15 through the groove A. The damper main body 17*a* has a second stage of edge damper 17. The attaching flange portion 17*b* is extended at the outer periphery of the damper main body 17*a* and fixed to an edge attaching portion 14*a* of the frame 14.

According to the diaphragm 15, as shown by FIG. 3, a reinforcing rib 24 by a groove portion or a ridge portion extended from a vicinity of a dome center portion to a dome outer periphery side is formed radially relative to the dome center. Each reinforcing rib 24 is terminated before the dome outer periphery.

The damper main body 17*a* is formed with a reinforcing rib 25 by a groove portion or a ridge portion to be along a width direction of the damper main body 17*a* within a range of the damper main body 17*a* excluding a vicinity of an inner peripheral portion and a vicinity of an outer peripheral portion.

According to the first embodiment, the diaphragm 15 and the edge dampers 16, 17 are formed by film material. The groove A and the reinforcing ribs 24, 25 are formed to predetermined shapes and dimensions by pressing.

According to the first embodiment of the speaker apparatus 10, when the dome type diaphragm 15 is formed with the reinforcing rib 24 extended from the vicinity of the dome center portion to the dome outer periphery side radially relative to the dome center and the reinforcing rib 24 is formed to be extended at the vicinity of the outer periphery of the diaphragm 15, a rigidity can be stable substantially over the entire region from a vicinity of the center of the dome type diaphragm 15 to a vicinity of the outer periphery portion.

Therefore, when it is compared with the speaker apparatus according to the related art mounted with the reinforcing rib only at the vicinity of the outer peripheral portion of the diaphragm bonded with the voice coil, even when an area of the dome portion is increased, the sufficient rigidity is ensured over an entire region of the dome type diaphragm 15 and high glade acoustic reproduction can be carried out by reducing a disturbance in a high region frequency characteristic by a harmonic distortion.

Figure 4:
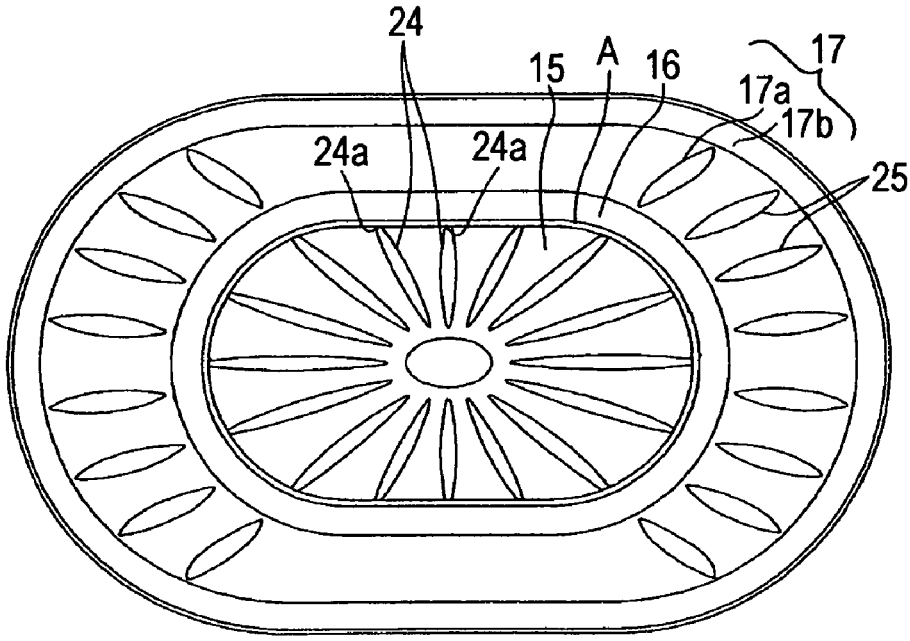
FIG. 4 is a front view of a dome type diaphragm and an edge damper of a speaker apparatus according to a second embodiment.

FIG. 4 is a front view of a dome type diaphragm and an edge damper according to a second embodiment.

The speaker apparatus of the second embodiment differs from that of the first embodiment in that an end portion 24*a* on the dome outer periphery side of the reinforcing rib 24 of the dome type diaphragm 15 is made to reach the dome outer periphery. The other constitution is common to that of the first embodiment and therefore, an explanation of the common constitution will be omitted.

According to the second embodiment, the rigidity of the dome outer peripheral edge can be promoted by making the reinforcing rib 24 mounted to the dome type diaphragm 15 reach the dome outer periphery, when the groove A is formed at the boundary portion of the dome outer periphery and the edge dampers 16, 17, a stable strength can be ensured for the groove A, even when the voice coil mounted to the outer periphery is the voice coil 18 which does not use a voice coil bobbin, a winding diameter of the coil is not disturbed and operation of integrating the voice coil is facilitated.

Figure 5:
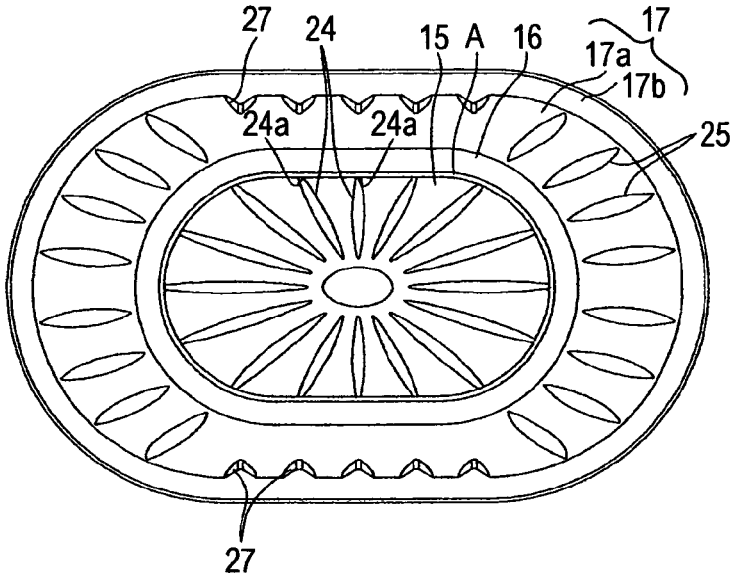
FIG. 5 is a front view of a dome type diaphragm and an edge damper according to a third embodiment.

FIG. 5 is a front view of a dome type diaphragm and an edge damper according to a third embodiment of the speaker.

According to the speaker of the third embodiment, in addition to an improvement in a diaphragm structure shown in the second embodiment, further, the linear region of the outer peripheral portion of the damper main body 17*a* is addedly formed with reinforcing ribs 27 by a recess and projection structure at pertinent intervals in the peripheral direction.

The other constitution of the reinforcing rib 27 may be common to that of the second embodiment, the common constitution is attached with the same numerals and an explanation thereof will be omitted.

When constituted in this way, the reinforcing rib 27 at the outer peripheral portion of the damper main body 17*a* promotes the rigidity of the outer peripheral edge of the damper main body 17*a* and therefore, in the case of the edge dampers 16, 17 integrated to the dome type diaphragm 15 having the oval shape, in the surrounding of the diaphragm, the difference of the compliances between the region in correspondence with the linear portion of the oval and the region in the circular arc shape on the both sides can be shrunk, and the compliances can be adjusted further freely by being combined with the reinforcing rib 25 of the background art formed in the range of the damper main body 17*a* excluding the vicinity of the inner peripheral portion and the vicinity of the outer peripheral portion as in the embodiment.

That is, a degree of freedom of adjusting the compliance of the edge damper 17 is increased, further, the low sound resonance frequency (fo) can be adjusted as aimed by enabling to ensure the desired compliance without variation over the entire region of the surrounding of the diaphragm 15.

Further, according to the constitution shown in FIG. 5, the effect by the reinforcing rib 24 formed at the dome type diaphragm 15 radially from the dome center is synergetically achieved, and the high glade acoustic reproduction reducing the disturbance in the high region frequency characteristic by the harmonic distortion can be achieved by ensuring the sufficient rigidity in the diaphragm 15.

Figure 6:
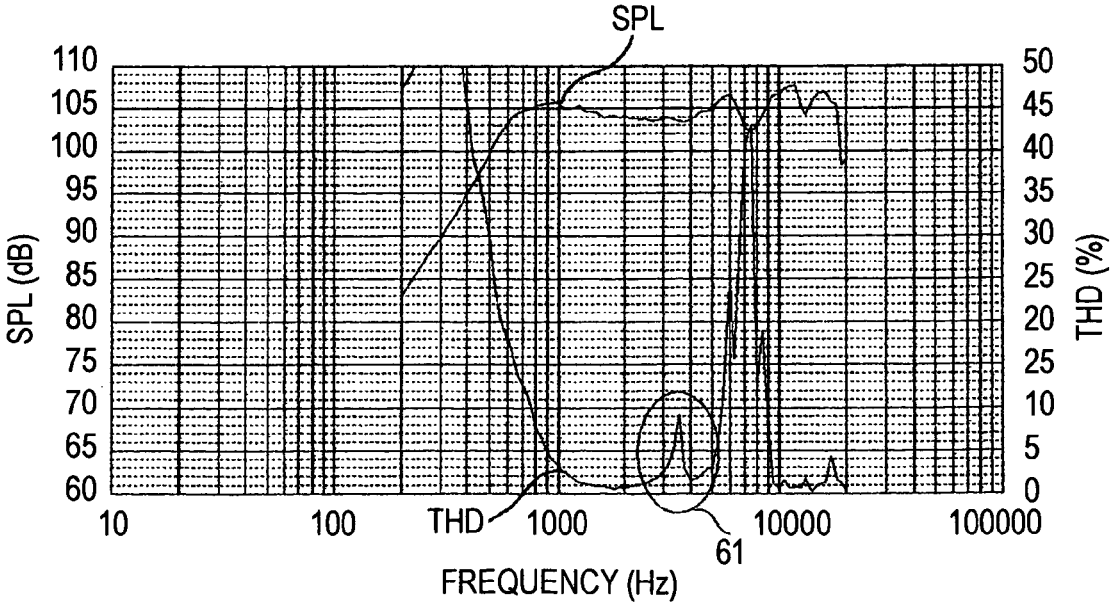
FIG. 6 shows an example of a characteristic graph of the speaker apparatus according to the first embodiment.
Figure 7:
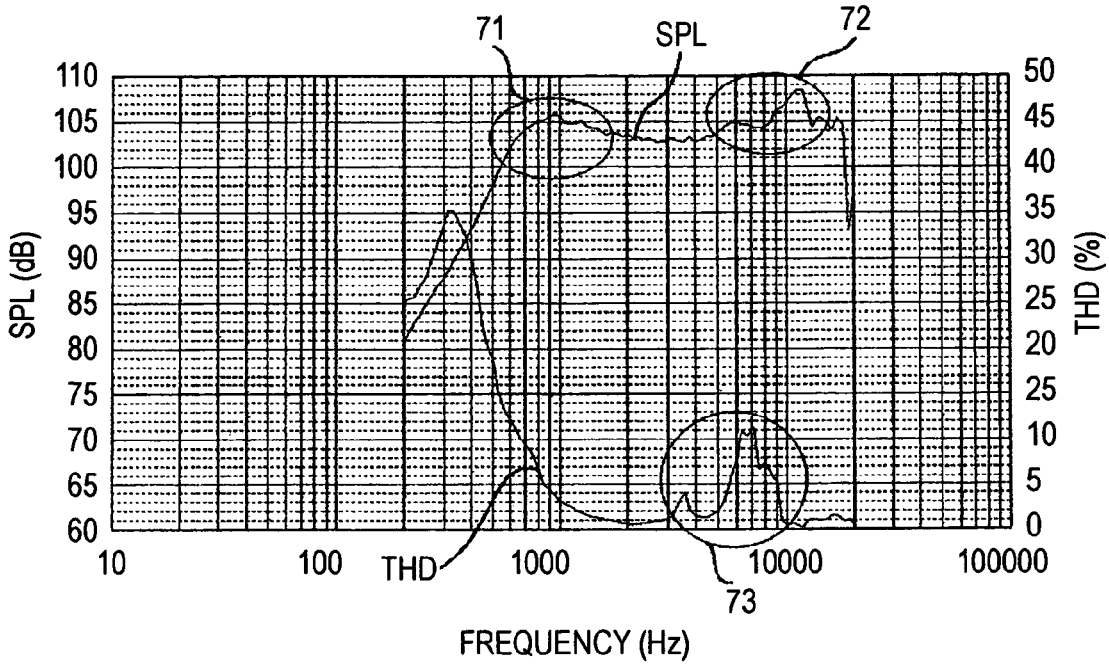
FIG. 7 shows an example of a characteristic graph of the speaker apparatus according to the third embodiment.

Next, FIG. 6 shows an example of a characteristic graph of the speaker apparatus according to the first embodiment and FIG. 7 shows an example of a characteristic graph of the speaker apparatus according to the third embodiment. In the drawings, notation SPL designates a sound pressure level characteristic (SPL sound pressure level) and notation THD designates a total harmonic distortion characteristic (total harmonic distortion) synthesized with respective harmonic distortions of first degree, second degree, third degree, . . . .

In FIG. 6, according to the total harmonic distortion characteristic, at a frequency region 61, a level of harmonic distortion is reduced more than in the background art.

In FIG. 7, according to the sound pressure level characteristic, at a frequency region 71, the low sound resonance frequency (fo) is shifted to a side of high frequencies. This shows that, for example, when desired fo is set to the side of high frequencies, fo of the speaker apparatus can be shifted to the side of high frequencies. Further, at a frequency region 72, peak, dip are reduced more than in the background art. Further, at the frequency region 73, the level of the harmonic distortion is reduced more than in the background art.

Further, the outer peripheral shape of the dome type diaphragm 15 used in the speaker apparatus is not limited to the oval shape shown in the above-embodiments. For example, even in a case of a diaphragm of an elliptical shape or a circular shape, an excellent effect can be achieved by mounting the above-described respective reinforcing ribs 24, 25, 27.

However, when the embodiments is applied to the dome type diaphragm of the oval shape or the elliptical shape, in the oval shape or the elliptical shape dome speaker apparatus aiming at the excellent low sound reproducing characteristic by gaining the area of the diaphragm even in a narrow installing space, the improvement in the high region frequency characteristic and the adjustment of the low sound resonance frequency (fo) are facilitated and the advantage of the oval shape or the elliptical shape dome type speaker apparatus can further be expanded.

According to the respective embodiments, in the speaker apparatus supported by the frame 14 by the edge dampers 16, 17 the outer peripheries of which are integrated with the dome type diaphragm 15, the diaphragm 15 is formed with the reinforcing rib 24 by the groove portion or the ridge portion extended from a vicinity of the dome center portion to the dome outer periphery side radially relative to the dome center.

When the dome type diaphragm 15 is formed with the reinforcing rib 24 extended from the vicinity of the dome center portion to the dome outer periphery side radially relative to the dome center and the reinforcing rib 25 (of the background art) is formed by being extended to the vicinity of the outer periphery of the diaphragm 15, there can be provided the stable rigidity substantially over the entire region from the vicinity of the center of the dome type diaphragm 15 to the vicinity of the outer peripheral portion. Therefore, in comparison with the speaker apparatus of the related art mounted with the reinforcing rib 25 (of the background art) only at the vicinity of the outer peripheral portion of the diaphragm 15 bonded with the voice coil, even when the area of the dome portion is increased, the high glade acoustic reproduction reducing the disturbance in the high region frequency characteristic by the harmonic distortion can be carried out by ensuring the sufficient rigidity over the entire region of the dome type diaphragm 15.

Further, by providing the edge damper 17 with the damper main body 17*a* integrated to the outer periphery of the diaphragm 15 and the attaching flange portion 17*b* extended to the outer periphery of the damper main body 17*a* and fixed to the edge attaching portion 14*a* of the frame 14 and forming the reinforcing rib 27 by the recess and projection structure at the outer peripheral portion of the damper main body 17*a*, the reinforcing rib 27 by the recess and projection structure promotes the rigidity of the outer peripheral edge of the damper main body 17*a* and therefore, in the case of the edge dampers 16, 17 integrated to the dome type diaphragm 15 in, for example, the oval shape or the elliptical shape, in the surrounding of the diaphragm 15, the difference of the compliances between the region in correspondence with the liner portion of the ellipse and the region in the circular arc shape on the both sides can be shrunk, and the compliance can further freely be adjusted by being combined with the reinforcing rib 25 of the background art formed with the region of the damper main body 17*a* excluding the vicinity of the inner peripheral portion and the vicinity of the outer peripheral portion.

That is, the degree of freedom of adjusting the compliance in the edge damper 17 is promoted, further, the desired compliance without the variation over the entire region of the surrounding of the diaphragm 15 can be ensured and the low sound resonance frequency (fo) can be adjusted as aimed.

Further, by forming the reinforcing rib 24 by the groove portion or the ridge portion extended from the vicinity of the dome center portion to the dome outer periphery side radially relative to the dome center and forming the reinforcing rib 27 by the recess and projection structure at the outer peripheral portion of the damper main body 17*a*, the effect by the reinforcing rib 24 formed at the dome type diaphragm 15 radially from the dome center and the effect by the reinforcing rib 27 by the recess and projection structure formed at the outer peripheral portion of the damper main body 17*a* are synergetically achieved, not only the high glade acoustic reproduction reducing the disturbance in the high region frequency characteristic by the harmonic distortion can be carried out by ensuring the sufficient rigidity in the dome type diaphragm 15 but also the desired compliance without the variation over the entire region of the surrounding of the diaphragm 15 is easily ensured and adjustment of the low sound resonance frequency (fo) can be facilitated as aimed.

According to the embodiments, a speaker apparatus comprises a dome type diaphragm comprising: a reinforcing rib; and an edge damper integrally formed with an outer periphery of the dome type diaphragm; and a frame supporting the dome type diaphragm through the edge damper. The reinforcing rib comprises at least one of a groove portion and a ridge portion. The reinforcing rib is extended radially with respect to the dome center portion from a vicinity of a dome center portion of the dome type diaphragm to a dome outer periphery side.

According to the embodiments, a speaker apparatus comprises: a dome type diaphragm and a frame supporting a dome type diaphragm through the edge damper. The dome type diaphragm comprises: an edge damper integrally formed with an outer periphery of the dome type diaphragm. The edge damper comprises a damper main body integrated to an outer periphery of the dome type diaphragm; an attaching flange portion being extended to an outer periphery of the damper main body; and a reinforcing rib formed by a recess and projection structure. The reinforcing rib is provided on an outer peripheral portion of the damper main body. The frame comprises an edge attaching portion fixing the attaching flange portion of the edge damper.

According to the embodiment, a speaker apparatus comprises a dome type diaphragm and a frame. The dome type diaphragm comprises a first reinforcing rib comprising at least one of a groove portion and a ridge portion and an edge damper integrally formed with an outer periphery of the dome type diaphragm. The first reinforcing rib is extended radially with respect to a dome center portion from a vicinity of the dome center portion of the dome type diaphragm to a dome outer periphery side. The edge damper comprises: a damper main body integrated to an outer periphery of the dome type diaphragm; an attaching flange portion being extended to an outer periphery of the damper main body; and a second reinforcing rib formed by a recess and projection structure. The second reinforcing rib is provided on an outer peripheral portion of the damper main body. The frame supports the dome type diaphragm through the edge damper. The frame comprises an edge attaching portion fixing the attaching flange portion of the edge damper.

What is claimed is:

1. A speaker apparatus comprising:

a dome type diaphragm having an elliptical shape or a track shape;

an edge damper integrally formed with an outer periphery of the dome type diaphragm, the edge damper having an elliptical shape or a track shape; and a frame supporting an outer periphery of the edge damper;

wherein a diameter of the edge damper reaches a minimum at a minor axis and the diameter reaches a maximum at a main axis;

wherein a plurality of first reinforcing ribs, each of which is formed by a recess and projection structure and is extended to an outer periphery of the edge damper, are formed on an area near the main axis of the edge damper;

wherein a plurality of second reinforcing ribs, each of which is formed by a recess and projection structure, are formed on an area near the minor axis of the edge damper; and wherein lengths of the second reinforcing ribs are smaller than lengths of the first reinforcing ribs.

2. The speaker apparatus according to claim 1, wherein end portions of the dome outer periphery side of the first reinforcing ribs are made to reach a dome outer periphery.

3. The speaker apparatus according to claim 1, wherein:

the edge damper includes:

a damper main body integrated to an outer periphery of the dome type diaphragm;

an attaching flange portion being extended to an outer periphery of the damper main body; and the second reinforcing ribs each of which is formed by a recess and projection structure, the second reinforcing ribs provided on an outer peripheral portion of the damper main body.

* * * * *